US008663031B2

(12) United States Patent
Okabe et al.

(10) Patent No.: US 8,663,031 B2
(45) Date of Patent: Mar. 4, 2014

(54) GOLF BALL

(75) Inventors: Satoko Okabe, Kobe (JP); Kazuhiko Isogawa, Kobe (JP); Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 340 days.

(21) Appl. No.: 13/240,182

(22) Filed: Sep. 22, 2011

(65) Prior Publication Data

US 2012/0172152 A1 Jul. 5, 2012

(30) Foreign Application Priority Data

Dec. 29, 2010 (JP) ..... 2010-294446

(51) Int. Cl.
*A63B 37/04* (2006.01)
*A63B 37/12* (2006.01)

(52) U.S. Cl.
USPC ..... 473/371; 473/376; 473/378

(58) Field of Classification Search
USPC ..... 473/351–378
See application file for complete search history.

(56) References Cited

U.S. PATENT DOCUMENTS

| | | | | |
|---|---|---|---|---|
| 5,072,944 | A | 12/1991 | Nakahara et al. | |
| 5,403,010 | A | 4/1995 | Yabuki et al. | |
| 5,516,110 | A | 5/1996 | Yabuki et al. | |
| 5,562,287 | A | 10/1996 | Endo et al. | |
| 6,129,640 | A | 10/2000 | Higuchi et al. | |
| 6,520,872 | B2 * | 2/2003 | Endo et al. | 473/374 |
| 6,712,718 | B2 * | 3/2004 | Endo et al. | 473/374 |
| 7,429,221 | B1 * | 9/2008 | Bulpett et al. | 473/376 |
| 7,537,529 | B2 * | 5/2009 | Bulpett et al. | 473/374 |
| 7,537,530 | B2 * | 5/2009 | Bulpett et al. | 473/374 |
| 7,744,489 | B2 * | 6/2010 | Sullivan et al. | 473/373 |
| 7,909,709 | B2 * | 3/2011 | Sullivan et al. | 473/373 |
| 8,030,383 | B2 * | 10/2011 | Comeau et al. | 524/335 |
| 8,157,674 | B2 * | 4/2012 | Sullivan et al. | 473/373 |
| 8,197,359 | B2 * | 6/2012 | Sullivan et al. | 473/371 |
| 8,216,090 | B2 * | 7/2012 | Watanabe | 473/373 |
| 8,257,200 | B2 * | 9/2012 | Sullivan et al. | 473/373 |
| 8,398,507 | B2 * | 3/2013 | Sullivan et al. | 473/371 |
| 2002/0019269 | A1 | 2/2002 | Watanabe | |

(Continued)

FOREIGN PATENT DOCUMENTS

| | | | |
|---|---|---|---|
| JP | 2009-261792 | A | 11/2009 |
| JP | 2010-22504 | A | 2/2010 |

*Primary Examiner* — Alvin Hunter
(74) *Attorney, Agent, or Firm* — Birch, Stewart, Kolasch & Birch, LLP

(57) ABSTRACT

A golf ball 2 includes a core 4, a mid layer 6, and a cover 8. The difference between: a hardness H(5.0) at a point located at a distance of 5 mm from the central point of the core 4; and a hardness Ho at the central point is 6.0 or greater. The difference between: a hardness H(12.5) at a point located at a distance of 12.5 mm from the central point; and the hardness H(5.0) is 4.0 or less. The difference between a hardness Hs at the surface of the core 4 and the hardness H(12.5) is 10.0 or greater. The difference between the hardness Hs and the hardness Ho is 22.0 or greater. In the core 4, there is no zone in which a hardness decreases from the central point to the surface. A hardness H3 of the cover 8 is greater than a hardness H2 of the mid layer 6. The cover 8 is formed from a resin composition containing a polyamide copolymer including a polymerized fatty acid (a-1), sebacic acid and/or azelaic acid (a-2), and a polyamine component (a-3).

19 Claims, 5 Drawing Sheets

(56) References Cited

U.S. PATENT DOCUMENTS

| | | | |
|---|---|---|---|
| 2002/0032077 | A1 | 3/2002 | Watanabe |
| 2003/0032501 | A1 | 2/2003 | Sakagami et al. |
| 2008/0194357 | A1 | 8/2008 | Higuchi |
| 2008/0312008 | A1 | 12/2008 | Higuchi et al. |
| 2009/0270203 | A1 | 10/2009 | Okabe |
| 2009/0312121 | A1 | 12/2009 | Isogawa et al. |
| 2010/0009776 | A1 | 1/2010 | Okabe et al. |

* cited by examiner

GOLF BALL

This application claims priority on Patent Application No. 2010-294446 filed in JAPAN on Dec. 29, 2010. The entire contents of this Japanese Patent Application are hereby incorporated by reference.

BACKGROUND OF THE INVENTION

1. Field of the Invention

The present invention relates to golf balls. Specifically, the present invention relates to golf balls including a solid core, a mid layer, and a cover.

2. Description of the Related Art

Golf players' foremost requirement for golf balls is flight performance. Golf players place importance on flight performance upon shots with a driver, a long iron, and a middle iron. An appropriate trajectory height is required in order to achieve a large flight distance. A trajectory height depends on a spin rate and a launch angle. In a golf ball that achieves a high trajectory by a high spin rate, a flight distance is insufficient. In a golf ball that achieves a high trajectory by a high launch angle, a large flight distance is obtained. Use of an outer-hard/inner-soft structure in a golf ball can achieve a low spin rate and a high launch angle.

JPH2-264674 (U.S. Pat. No. 5,072,944) discloses a golf ball that includes a core consisting of a center core and an outer layer. The center core is flexible, and the outer layer is hard. The core suppresses a spin rate.

JPH6-98949 (U.S. Pat. No. 5,516,110) discloses a golf ball having a constant hardness between: a point that is located at a distance of 5 mm from a central point; and a point that is located at a distance of 10 mm from the central point. A similar golf ball is also disclosed in JPH6-154357 (U.S. Pat. No. 5,403,010).

JPH7-112036 (U.S. Pat. No. 5,562,287) discloses a golf ball having a small difference between a central hardness and a surface hardness of a core. The core contributes to the resilience performance of the golf ball.

JPH11-253578 (U.S. Pat. No. 6,129,640) discloses a golf ball that includes a core, a mid layer having a specific gravity higher than the specific gravity of the core, and a cover having a hardness less than the hardness of the mid layer.

JP2002-764 (US 2002/0032077) discloses a golf ball having a great difference between a central hardness and a surface hardness of a core. A similar golf ball is also disclosed in JP2002-765 (US 2002/0019269).

JP2003-33447 (US 2003/0032501) discloses a golf ball that includes a core for which a rubber composition includes a polysulfide. The polysulfide contributes to the resilience performance of the golf ball.

JP2008-194473 (US 2008/0194357 and US 2008/0312008) discloses a golf ball having a great difference between a central hardness and a surface hardness of a core. A similar golf ball is also disclosed in JP2010-22504.

JP2009-297261 (US 2009/0312121) discloses a golf ball that includes a center, a mid layer having a hardness less than the surface hardness of the center, and a cover having a weight less than the weight of the mid layer.

For a cover, a highly rigid resin may be used. The highly rigid resin can suppress spin. In general, a highly rigid resin has inferior fluidity. Therefore, it is difficult to form this cover. It is particularly difficult to form a thin cover. For the purpose of improving moldability, a low-molecular-weight material may be blended with a highly rigid resin.

In general, a highly rigid resin has inferior impact resistance. For the purpose of improving impact resistance, a polymer including a rubber component may be blended with a highly rigid resin.

Golf balls in which a highly rigid resin is used are disclosed in JP2010-17414 (US 2010/0009776), JP2009-261791 (US 2009/0270203), and JP2009-261792.

In the golf ball disclosed in JPH2-264674, the structure of the core is complicated. The core produces an energy loss when being hit. In addition, the core has inferior durability.

In the golf ball disclosed in JPH6-98949, a range where the hardness is constant is narrow. The golf ball has inferior resilience performance. Similarly, the golf ball disclosed in JPH6-154357 also has inferior resilience performance.

In the golf ball disclosed in JPH7-112036, a spin rate is excessive. The golf ball has a small flight distance.

In the golf ball disclosed in JPH11-253578, the resilience performance is impaired by the mid layer. The golf ball has a small flight distance.

The golf ball disclosed in JP2002-764 has inferior resilience performance. Similarly, the golf ball disclosed in JP2002-765 also has inferior resilience performance.

In the golf ball disclosed in JP2003-33447, a spin rate is excessive. The golf ball has inferior flight performance.

In the golf ball disclosed in JP2008-194473, there is a zone in which a hardness decreases from the central point of the core toward the surface of the core. The golf ball has inferior resilience performance. In the golf ball, a spin rate is excessive. The golf ball has inferior flight performance. Similarly, the golf ball disclosed in JP2010-22504 also has inferior flight performance.

In the golf ball disclosed in JP2009-297261, the difference between the surface hardness and the central hardness of the core is not great. In the golf ball, a spin rate is excessive. The golf ball has inferior flight performance.

In a cover including a highly rigid resin and a low-molecular-weight material, the low-molecular-weight material bleeds. This bleeding impairs adhesion of a mark layer to the cover. This bleeding impairs adhesion of a paint layer to the cover. This bleeding further promotes separation of the cover from the mid layer.

In a composition in which a polymer including a rubber component is blended with a highly rigid resin, the polymer impairs fluidity. It is difficult to form a thin cover from this composition.

An object of the present invention is to provide a golf ball that has excellent flight performance and that can be manufactured easily.

SUMMARY OF THE INVENTION

A golf ball according to the present invention comprises a core, a mid layer positioned outside the core, and a cover positioned outside the mid layer. A difference between: a JIS-C hardness H (5.0) at a point that is located at a distance of 5 mm from a central point of the core; and a JIS-C hardness Ho at the central point is equal to or greater than 6.0. A difference between: a JIS-C hardness H(12.5) at a point that is located at a distance of 12.5 mm from the central point; and the hardness H(5.0) is equal to or less than 4.0. A difference between a JIS-C hardness Hs at a surface of the core and the hardness H(12.5) is equal to or greater than 10.0. A difference between the hardness Hs and the hardness Ho is equal to or greater than 22.0. In the core, there is no zone in which a hardness decreases from the central point toward the surface. A Shore D hardness H3 of the cover is greater than a Shore D hardness H2 of the mid layer. The cover is formed from a resin composition. A base resin of the resin composition contains the following components (A) and (B).

The component (A) is a polyamide copolymer that contains:

(a-1) a polymerized fatty acid, (a-2) sebacic acid and/or azelaic acid, and (a-3) a polyamine component.

The component (B) includes at least one member selected from the group consisting of:

(b-1) a binary copolymer formed with an olefin and an α,β-unsaturated carboxylic acid having 3 to 8 carbon atoms, (b-2) a metal ion neutralized product of a binary copolymer formed with an olefin and an α,β-unsaturated carboxylic acid having 3 to 8 carbon atoms, (b-3) a ternary copolymer formed with: an olefin; an α,β-unsaturated carboxylic acid having 3 to 8 carbon atoms; and an α,β-unsaturated carboxylate ester, and (b-4) a metal ion neutralized product of a ternary copolymer formed with: an olefin; an α,β-unsaturated carboxylic acid having 3 to 8 carbon atoms; and an α,β-unsaturated carboxylate ester.

In the golf ball according to the present invention, a hardness distribution is appropriate. When the golf ball is hit with a driver, the spin rate is low. The low spin rate achieves a large flight distance. The cover of the golf ball has excellent fluidity. It is easy to produce the golf ball.

Preferably, the resin composition of the cover further contains a polyamide resin composition (C). The polyamide resin composition includes:

(c-1) a polyamide resin, and (c-2) a resin having at least one functional group selected from the group consisting of a hydroxyl group, a carboxyl group, an anhydride group, a sulfonic group, and an epoxy group (including a glycidyl group).

Preferably, the resin composition of the cover contains at least either one of the binary copolymer (b-1) or the metal ion neutralized product of the binary copolymer (b-2), and at least either one of the ternary copolymer (b-3) or the metal ion neutralized product of the ternary copolymer (b-4). Preferably, the resin composition of the cover contains the metal ion neutralized product of the binary copolymer (b-2) and the metal ion neutralized product of the ternary copolymer (b-4).

Preferably, the resin composition of the cover contains, as the metal ion neutralized product of the binary copolymer (b-2), a binary ionomer resin neutralized with sodium and a binary ionomer resin neutralized with zinc.

In the resin composition of the cover, a proportion of a sum of the component (A) and the component (B) to a total base resin may be 100% by weight. Preferably, a proportion of the component (A) to the total base resin is equal to or greater than 10% by weight but equal to or less than 80% by weight, and a proportion of the component (B) to the total base resin is equal to or greater than 20% by weight but equal to or less than 90% by weight.

In the resin composition of the cover, a proportion of a sum of the component (A), the component (B), and the component (C) to a total base resin may be 100% by weight. Preferably, a proportion of the component (A) to the total base resin is equal to or greater than 1% by weight but equal to or less than 70% by weight; a proportion of the component (B) to the total base resin is equal to or greater than 15% by weight but equal to or less than 65% by weight, and a proportion of the component (C) to the total base resin is equal to or greater than 15% by weight but equal to or less than 60% by weight.

Preferably, a melt flow rate (240° C.×2.16 kg) of the resin composition of the cover is equal to or greater than 10 g/10 min. Preferably, a flexural modulus of the resin composition of the cover is equal to or greater than 350 MPa but equal to or less than 1000 MPa. Preferably, the Shore D hardness H3 of the cover is equal to or greater than 66 but equal to or less than 75.

The core may be formed by crosslinking a rubber composition that includes a base rubber and an organic sulfur compound. Preferably, the organic sulfur compound has a molecular weight of 150 or higher but 200 or lower and a melting point of 65° C. or higher but 90° C. or lower. Preferably, the rubber composition includes the base rubber in an amount of 100 parts by weight, and the organic sulfur compound in an amount that is equal to or greater than 0.05 parts by weight but equal to or less than 3.0 parts by weight. Preferably, the sulfur compound is 2-naphthalenethiol.

Preferably, the hardness Ho is equal to or greater than 40.0 but equal to or less than 70.0, and the hardness Hs is equal to or greater than 78.0 but equal to or less than 95.0.

Preferably, a thickness of the mid layer is equal to or greater than 0.5 mm but equal to or less than 1.2 mm. Preferably, a thickness of the cover is equal to or greater than 0.3 mm but equal to or less than 1.5 mm.

Preferably, a sum (W2+W3) of a weight W2 of the mid layer and a weight W3 of the cover is equal to or greater than 8.4 g but equal to or less than 12.0 g. Preferably, a sum (V2+V3) of a volume V2 of the mid layer and a volume V3 of the cover is equal to or less than 10 $cm^3$.

Preferably, a difference between a specific gravity of the mid layer and a specific gravity of the core is equal to or greater than 0.05 but equal to or less than 0.4.

Preferably, a difference between a hardness of the cover and a hardness of the mid layer is equal to or greater than 4 but equal to or less than 20.

DESCRIPTION OF THE PREFERRED EMBODIMENTS

The following will describe in detail the present invention, based on preferred embodiments with reference to the accompanying drawings.

Figure 1:
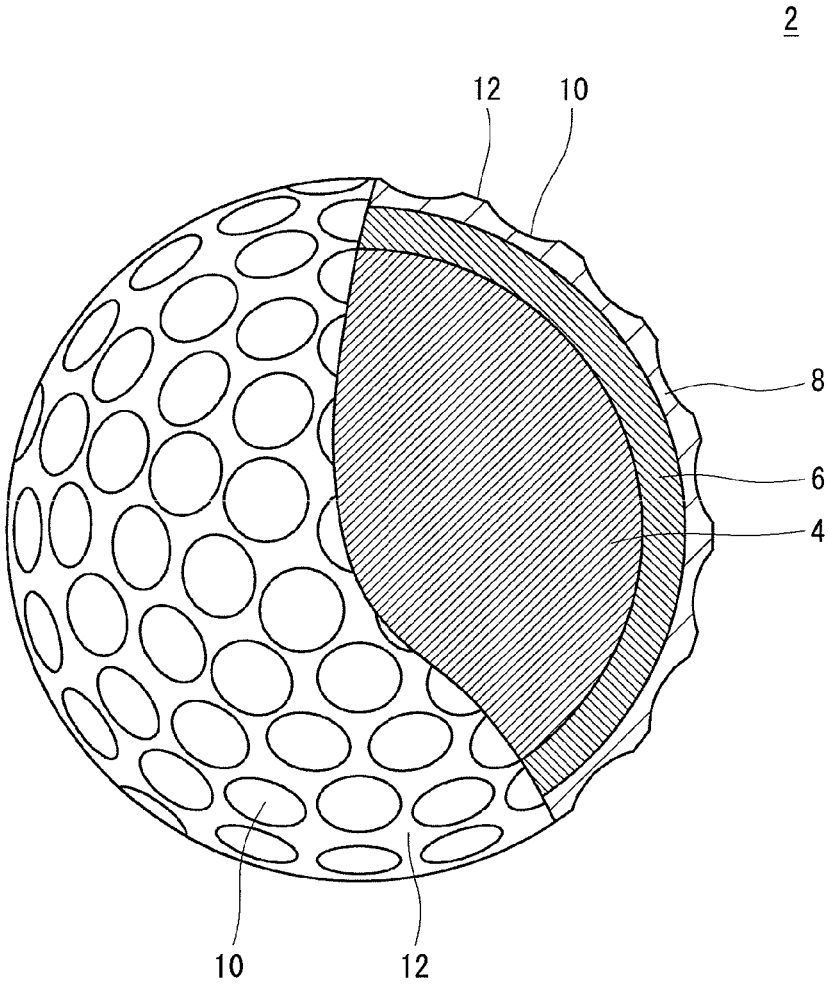
FIG. 1 is a partially cutaway cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. On the surface of the cover 8, a large number of dimples 10 are formed. Of the surface of the golf ball 2, a part other than the dimples 10 is a land 14. The golf ball 2 includes a paint layer and a mark layer on the external side of the cover 8 although these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

In the present invention, a JIS-C hardness at a point that is located at a distance of x (mm) from the central point of the core 4 is indicated by H(x). In the present invention, a hardness at the central point of the core 4 is indicated by Ho, and a surface hardness of the core 4 is indicated by Hs.

The hardness Ho and the hardness H(x) are measured by pressing a JIS-C type hardness scale against a cut plane of the core 4 that has been cut into two halves. For the measurement, an automated rubber hardness measurement machine (trade name "P1", manufactured by Kobunshi Keiki Co., Ltd.), to which this hardness scale is mounted, is used. The surface hardness Hs is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

Figure 2:
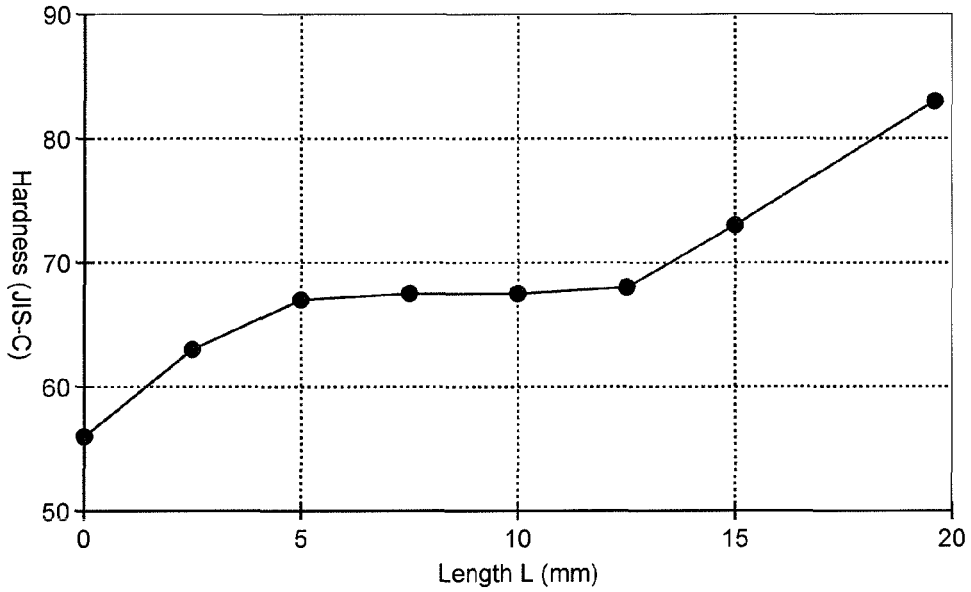
FIG. 2 is a graph showing a hardness distribution of a core of the golf ball in FIG. 1.

FIG. 2 shows a hardness distribution of the core 4. In this embodiment, the core 4 has a diameter of 39.2 mm. Thus, in FIG. 2, a hardness at a point that is located at a distance of 19.6 mm from the central point is the hardness Hs at the surface. As is obvious from FIG. 2, in the core 4, there is no zone in which the hardness decreases from the central point toward the surface. The core 4 has an outer-hard/inner-soft structure. The core 4 has a low energy loss when being hit. The core 4 has excellent resilience performance. In the core 4, spin is suppressed. The core 4 contributes to the flight performance of the golf ball 2.

As shown in FIG. 2, in this embodiment, a hardness H(5.0) is 67.0, and the hardness Ho is 56.0. The difference (H(5.0)−Ho) between the hardness H(5.0) and the hardness Ho is 11.0. The difference (H(5.0)−Ho) is great. In the golf ball 2 in which the difference (H(5.0)−Ho) is great, a spin rate is low when the golf ball 2 is hit with a driver. The low spin rate can achieve a large flight distance. In light of suppression of spin, the difference (H(5.0)−Ho) is preferably equal to or greater than 6.0 and particularly preferably equal to or greater than 8.0. In light of ease of producing the core 4, the difference (H(5.0)−Ho) is preferably equal to or less than 15.0.

As shown in FIG. 2, in this embodiment, a hardness H(12.5) is 68.0, and the hardness H(5.0) is 67.0. The difference (H(12.5)−H(5.0)) between the hardness H(12.5) and the hardness H(5.0) is 1.0. The difference (H(12.5)−H(5.0)) is small. In the core 4, the hardness distribution curve is almost flat between: a point that is located at a distance of 5.0 mm from the central point; and a point that is located at a distance of 12.5 mm from the central point. In the golf ball 2 in which the difference (H(12.5)−H(5.0)) is small, an energy loss is low when the golf ball 2 is hit with a driver. The golf ball 2 has excellent resilience performance. In light of resilience performance, the difference (H(12.5)−H(5.0)) is preferably equal to or greater than 0.0 but equal to or less than 4.0, more preferably equal to or greater than 0.5 but equal to or less than 3.0, and particularly preferably equal to or greater than 0.5 but equal to or less than 1.5.

As shown in FIG. 2, in this embodiment, the hardness Hs is 83.0, and the hardness H(12.5) is 68.0. The difference (Hs−H(12.5)) between the hardness Hs and the hardness H(12.5) is 15.0. The difference (Hs−H(12.5)) is great. In the golf ball 2 in which the difference (Hs−H(12.5)) is great, a spin rate is low when the golf ball 2 is hit with a driver. The low spin rate can achieve a large flight distance. In light of suppression of spin, the difference (Hs−H(12.5)) is preferably equal or greater than 10.0, more preferably equal to or greater than 13.0, and particularly preferably equal to or greater than 14.0. In light of ease of producing the core 4, the difference (Hs−H(12.5)) is preferably equal to or less than 20.0.

As described above, in this embodiment, the hardness Ho is 56.0, and the hardness Hs is 83.0. The difference (Hs−Ho) between the hardness Hs and the hardness Ho is 27.0. The difference (Hs−Ho) is great. In the golf ball 2 in which the difference (Hs−Ho) is great, a spin rate is low when the golf ball 2 is hit with a driver. The low spin rate can achieve a large flight distance. In light of suppression of spin, the difference (Hs−Ho) is preferably equal to or greater than 22.0 and particularly preferably equal to or greater than 24.0. In light of ease of producing the core 4, the difference (Hs−Ho) is preferably equal to or less than 35.0.

The hardness Ho at the central point is preferably equal to or greater than 40.0 but equal to or less than 70.0. The golf ball 2 in which the hardness Ho is equal to or greater than 40.0 has excellent resilience performance. In this respect, the hardness Ho is more preferably equal to or greater than 45.0 and particularly preferably equal to or greater than 50.0. The core 4 in which the hardness Ho is equal to or less than 70.0 can achieve an outer-hard/inner-soft structure. In the golf ball 2 that includes this core 4, spin can be suppressed. In this respect, the hardness Ho is more preferably equal to or less than 66.0 and particularly preferably equal to or less than 64.0.

The hardness H(5.0) is preferably equal to or greater than 62.0 but equal to or less than 72.0. The golf ball 2 in which the hardness H(5.0) is equal to or greater than 62.0 has excellent resilience performance. In this respect, the hardness H(5.0) is particularly preferably equal to or greater than 64.0. The golf ball 2 in which the hardness H(5.0) is equal to or less than 72.0 provides excellent feel at impact. In this respect, the hardness H(5.0) is particularly preferably equal to or less than 70.0.

The hardness H(12.5) is preferably equal to or greater than 63.0 but equal to or less than 73.0. The golf ball 2 in which the hardness H(12.5) is equal to or greater than 63.0 has excellent resilience performance. In this respect, the hardness H(12.5) is particularly preferably equal to or greater than 65.0. The golf ball 2 in which the hardness H(12.5) is equal to or less than 73.0 provides excellent feel at impact. In this respect, the hardness H(12.5) is particularly preferably equal to or less than 71.0.

The hardness Hs at the surface of the core 4 is preferably equal to or greater than 78.0 but equal to or less than 95.0. The core 4 in which the hardness Hs is equal to or greater than 78.0 can achieve an outer-hard/inner-soft structure. In the golf ball 2 that includes this core 4, spin can be suppressed. In this respect, the hardness Hs is more preferably equal to or greater than 80.0 and particularly preferably equal to or greater than 82.0. The golf ball 2 in which the hardness Hs is equal to or less than 95.0 has excellent durability. In this respect, the hardness Hs is more preferably equal to or less than 93.0 and particularly preferably equal to or less than 88.0.

The core 4 is obtained by crosslinking a rubber composition. Examples of base rubbers for use in the rubber composition of the core 4 include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight.

The proportion of cis-1,4 bonds in the polybutadiene is preferably equal to or greater than 40% and more preferably equal to or greater than 80%.

The rubber composition of the core 4 includes a co-crosslinking agent. The co-crosslinking agent achieves high resilience of the core 4. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 15 parts by weight, and more preferably equal to or greater than 25 parts by weight, per 100 parts by weight of the base rubber. In light of soft feel at impact, the amount of the co-crosslinking agent is preferably equal to or less than 50 parts by weight, and particularly preferably equal to or less than 45 parts by weight, per 100 parts by weight of the base rubber.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 parts by weight, more preferably equal to or greater than 0.2 parts by weight, and particularly preferably equal to or greater than 0.3 parts by weight, per 100 parts by weight of the base rubber. In light of soft feel at impact, the amount of the organic peroxide is preferably equal to or less than 2.0 parts by weight, more preferably equal to or less than 1.5 parts by weight, and particularly preferably equal to or less than 1.0 parts by weight, per 100 parts by weight of the base rubber.

Preferably, the rubber composition of the core 4 includes an organic sulfur compound. In light of achievement of both excellent resilience performance and a low spin rate, an organic sulfur compound having a molecular weight of 150 or higher but 200 or lower is preferred. The molecular weight is particularly preferably equal to or higher than 155. The molecular weight is particularly preferably equal to or lower than 170.

In light of achievement of both excellent resilience performance and a low spin rate, an organic sulfur compound having a melting point of 65° C. or higher but 90° C. or lower. The melting point is particularly preferably equal to or higher than 75° C. The melting point is particularly preferably equal to or lower than 85° C.

Organic sulfur compounds include naphthalenethiol type compounds, benzenethiol type compounds, and disulfide type compounds.

Examples of naphthalenethiol type compounds includes 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol type compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide type compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

From the standpoint that the core 4 having an appropriate hardness distribution is obtained, particularly preferable organic sulfur compounds are 1-naphthalenethiol and 2-naphthalenethiol. The molecular weight of each of 1-naphthalenethiol and 2-naphthalenethiol is 160.2. The melting point of 2-naphthalenethiol is 79° C. to 81° C.

The most preferable organic sulfur compound is 2-naphthalenethiol. The chemical formula of 2-naphthalenethiol is shown below.

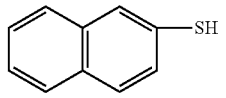

From the standpoint that the core 4 having an appropriate hardness distribution is obtained, the amount of the organic sulfur compound is preferably equal to or greater than 0.05 parts by weight, more preferably equal to or greater than 0.08 parts by weight, and particularly preferably equal to or greater than 0.10 parts by weight, per 100 parts by weight of the base rubber. In light of resilience performance, the amount of the organic sulfur compound is preferably equal to or less than 3.0 parts by weight, more preferably equal to or less than 2.0 parts by weight, and particularly preferably equal to or less than 1.0 parts by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. The amount of the filler is determined as appropriate so that the intended specific gravity of the core 4 is accomplished. A particularly preferable filler is zinc oxide. Zinc oxide serves not only as a specific gravity adjuster but also as a crosslinking activator.

According to need, an anti-aging agent, a coloring agent, a plasticizer, a dispersant, sulfur, an vulcanization accelerator, and the like are added to the rubber composition of the core 4. Crosslinked rubber powder or synthetic resin powder may be also dispersed in the rubber composition.

The core 4 has a diameter of preferably 38.0 mm or greater but 42.0 mm or less. The core 4 having a diameter of 38.0 mm or greater can achieve excellent resilience performance of the golf ball 2. The core 4 having a diameter of 38.0 mm or greater can achieve an outer-heavy/inner-light structure of the golf ball 2. In this respect, the diameter is more preferably equal to or greater than 39.0 mm and particularly preferably equal to or greater than 39.2 mm. In the golf ball 2 that includes the core 4 having a diameter of 42.0 mm or less, the mid layer 6 and the cover 8 can have sufficient thicknesses. The golf ball 2 that includes the mid layer 6 and the cover 8 having large thicknesses has excellent durability. In this respect, the diameter is more preferably equal to or less than 41 mm and particularly preferably equal to or less than 40 mm. The core 4 may have two or more layers.

For the mid layer 6, a resin composition is suitably used. Examples of the base polymer of the resin composition include ionomer resins, styrene block-containing thermoplastic elastomers, thermoplastic polyester elastomers, thermoplastic polyamide elastomers, and thermoplastic polyolefin elastomers.

Particularly preferable base polymers are ionomer resins. The golf ball 2 that includes the mid layer 6 including an ionomer resin has excellent resilience performance. An ionomer resin and another resin may be used in combination for the mid layer 6. In this case, the principal component of the base polymer is preferably the ionomer resin. Specifically, the proportion of the ionomer resin to the entire base polymer is preferably equal to or greater than 50% by weight, more preferably equal to or greater than 60% by weight, and particularly preferably equal to or greater than 70% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7327", "Himilan AM7329", "Himilan AM7337", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

Two or more types of ionomer resins may be used in combination for the mid layer 6. An ionomer resin neutralized with a monovalent metal ion, and an ionomer resin neutralized with a bivalent metal ion may be used in combination.

A preferable resin that can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more types selected from the group consisting of SBS, SIS, SIBS, SEBS, SEPS, SEEPS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the mid layer 6 in an adequate amount.

Preferably, the mid layer 6 includes powder of a metal having a high specific gravity. The specific gravity of the mid layer 6 is high. The specific gravity SG2 of the mid layer 6 is higher than the specific gravity SG1 of the core 4. The mid layer 6 and the core 4 achieve an outer-heavy/inner-light structure of the golf ball 2. In the golf ball 2 having an outer-heavy/inner-light structure, backspin is suppressed. In the golf ball 2, a large flight distance is obtained. In the golf ball 2 having an outer-heavy/inner-light structure, sidespin is suppressed. The golf ball 2 has excellent directional stability. Specific examples of metals having a high specific gravity include tungsten and molybdenum. Tungsten is particularly preferred.

The amount of the powder of the metal having a high specific gravity is preferably equal to or greater than 10 parts by weight, more preferably equal to or greater than 15 parts by weight, and particularly preferably equal to or greater than 22 parts by weight, per 100 parts by weight of the base polymer. In light of ease of producing the golf ball 2, the amount is preferably equal to or less than 50 parts by weight per 100 parts by weight of the base polymer.

In light of flight distance and directional stability, the difference (SG2−SG1) between the specific gravity SG2 of the mid layer 6 and the specific gravity SG1 of the core 4 is preferably equal to or greater than 0.05 and particularly preferably equal to or greater than 0.10. In light of ease of producing the golf ball 2, the difference (SG2−SG1) is preferably equal to or less than 0.4.

In light of flight distance and directional stability, the specific gravity SG2 of the mid layer 6 is preferably equal to or greater than 1.05, more preferably equal to or greater than 1.10, and particularly preferably equal to or greater than 1.14. In light of ease of producing the golf ball 2, the specific gravity SG2 is preferably equal to or less than 1.5.

From the standpoint that an outer-hard/inner-soft structure can be achieved in the sphere consisting of the core 4 and the mid layer 6, the mid layer 6 has a hardness H2 of preferably 35 or greater, more preferably 40 or greater, and particularly preferably 45 or greater. In light of feel at impact of the golf ball 2, the hardness H2 is preferably equal to or less than 57 and particularly preferably equal to or less than 55. The hardness H2 is measured according to the standards of "ASTM-D 2240-68" with a Shore D type spring hardness scale mounted to an automated rubber hardness measurement machine (trade name "P1", manufactured by Kobunshi Keiki Co., Ltd.). For the measurement, a slab that is formed by hot press and that has a thickness of about 2 mm is used. A slab kept at 23° C. for two weeks is used for the measurement. At the measurement, three slabs are stacked. A slab formed from the same resin composition as the resin composition of the mid layer 6 is used.

From the standpoint that an outer-hard/inner-soft structure can be achieved in the sphere, the hardness H2 of the mid layer 6 is preferably greater than the Shore D hardness at the surface of the core 4. The Shore D hardness at the surface of the core 4 is measured by pressing a Shore D type hardness scale against the surface of the core 4. For the measurement, an automated rubber hardness measurement machine (trade name "P1", manufactured by Kobunshi Keiki Co., Ltd.), to which this hardness scale is mounted, is used.

The mid layer 6 has a thickness of preferably 0.5 mm or greater but 1.2 mm or less. In the sphere that includes the mid layer 6 having a thickness of 0.5 mm or greater, an outer-heavy/inner-light structure can be achieved. In this respect, the thickness is more preferably equal to or greater than 0.7 mm and particularly preferably equal to or greater than 0.8 mm. The golf ball 2 that includes the mid layer 6 having a thickness of 1.2 mm or less has excellent resilience performance. In this respect, the thickness is particularly preferably equal to or less than 1.0 mm.

For forming the mid layer 6, known methods such as injection molding, compression molding, and the like can be used. The mid layer 6 may have two or more layers.

For the cover 8, a resin composition is suitably used. The base resin of the resin composition contains the following components (A) and (B).

The component (A) is a polyamide copolymer that includes:

(a-1) a polymerized fatty acid, (a-2) sebacic acid and/or azelaic acid, and (a-3) a polyamine component.

The component (A) increases the fluidity of the resin composition. The resin composition is highly rigid but has excellent fluidity. The highly rigid resin composition can achieve an outer-hard/inner-soft structure of the golf ball 2. In the golf ball 2, spin can be suppressed. Since the component (A) is a copolymer, bleeding of a low-molecular-weight substance does not occur in the cover 8. The cover 8 has excellent adhesion to the mark layer and the paint layer. The cover 8 further has excellent adhesion to the mid layer 6. Since the resin composition has excellent fluidity, the cover 8 can easily be formed. A thin cover 8 can also easily be formed from the resin composition. In the golf ball 2 that includes the thin cover 8, a large core 4 can be used. The large core 4 can contribute to the resilience performance of the golf ball 2.

The polyamide copolymer (A) is a polymer having an amide bond as a repeat unit in the molecular chain. The polymer is obtained by a copolymerization reaction of:

(a-1) the polymerized fatty acid, (a-2) sebacic acid and/or azelaic acid, and (a-3) the polyamine component.

The polyamide copolymer (A) includes a polyamide resin and a polyamide elastomer. The polyamide resin is composed of only a polyamide component obtained by copolymerization of the polymerized fatty acid (a-1), sebacic acid and/or azelaic acid (a-2), and the polyamine component (a-3). Meanwhile, the polyamide elastomer includes a hard segment portion composed of a polyamide component, and a soft segment portion composed of a polyether-ester component or a polyether component. An example of the polyamide elastomer is a polyether-ester amide obtained by a reaction of: a polyamide component that includes the polymerized fatty acid (a-1), sebacic acid and/or azelaic acid (a-2), and the polyamine component (a-3); and a polyether-ester component that is composed of a polyoxyalkylene glycol (a-4) and a dicarboxylic acid (a-5). Another example of the polyamide elastomer is a polyether amide obtained by a reaction of: a polyamide component that includes the polymerized fatty acid (a-1), sebacic acid and/or azelaic acid (a-2), and the polyamine component (a-3); and a polyether that is composed of a polyoxyalkylene glycol whose both ends are aminated or carboxylated and a dicarboxylic acid or a diamine.

The carbon number of the polymerized fatty acid (a-1) is preferably equal to or greater than 20 but equal to or less than 48. The polymerized fatty acid (a-1) is preferably an unsaturated fatty acid. For example, a polymerized fatty acid obtained by polymerization of a monobasic fatty acid having 10 to 24 carbon atoms and one or more double bonds or triple bonds is preferred. Examples of the polymerized fatty acid (a-1) include dimmers such as oleic acid, linolic acid, erucic acid, and the like.

A commercially available polymerized fatty acid (a-1) normally includes a dimerized fatty acid as a principal component, and further includes a fatty acid that is a raw material and a trimerized fatty acid. The proportion of the dimerized fatty acid in the polymerized fatty acid (a-1) is preferably equal to or greater than 70% by weight and particularly preferably equal to or greater than 95% by weight. A polymerized fatty acid whose degree of unsaturation is decreased by hydrogenation is desirable. Specific examples of the polymerized fatty acid (a-1) include trade names "Pripol 1009" and "Pripol 1004" manufactured by Uniqema and trade name "Enpol 1010" manufactured by Henkel AG & CO.

An example of a polybasic acid component that is used in combination with the polymerized fatty acid is (a-2) azelaic acid, sebacic acid, or a mixture thereof. The polybasic acid has excellent polymerizability and excellent copolymerizability with the polymerized fatty acid. The polybasic acid can also contribute to the properties of the polyamide copolymer.

As the polyamine component (a-3), a diamine having 2 to 20 carbon atoms is preferred. Examples of a preferable polyamine component (a-3) include diamines such as ethylenediamine, 1,4-diaminobutane, hexamethylenediamine, nonamethylenediamine, undecamethylenediamine, dodecamethylenediamine, 2,2,4-trimethylhexamethylenediamine, bis-(4,4'-aminocyclohexyl)methane, and methaxylylenediamine.

Examples of the polyoxyalkylene glycol component (a-4) include polyoxyethylene glycol, polyoxypropylene glycol, polyoxytetramethylene glycol, a block copolymer of ethylene oxide and propylene oxide, a random copolymer of ethylene oxide and propylene oxide, a block copolymer of ethylene oxide and tetrahydrofuran, and a random copolymer of ethylene oxide and tetrahydrofuran. Both ends of these polymers may be aminated or carboxylated. The number average molecular weights of these polyoxyalkylene glycols are preferably equal to or greater than 200 but equal to or less than 3000.

The carbon number of the dicarboxylic acid (a-5) is preferably equal to or greater than 6 but equal to or less than 20. Examples of a preferable dicarboxylic acid (a-5) include aliphatic dicarboxylic acids such as adipic acid, azelaic acid, sebacic acid, and dodecanedioic acid; aromatic dicarboxylic acids such as terephthalic acid and isophthalic acid; and alicyclic dicarboxylic acid such as 1,4-cyclohexane dicarboxylic acid. In light of porimerizability and in light of properties of the polyamide elastomer, adipic acid, azelaic acid, sebacic acid, dodecanedioic acid, terephthalic acid, and isophthalic acid are preferred.

In a preferable method for producing the polyamide copolymer (A), polycondensation of the polymerized fatty acid (a-1), azelaic acid and/or sebacic acid (a-2), and the polyamine component (a-3) is performed. In the polycondensation, the weight ratio of the component (a-1) to the component (a-2) is preferably equal to or greater than 0.25 but equal to or less than 5.2. In the polycondensation, it is preferred that an amino group is substantially equivalent to a carboxyl group. When the weight ratio of the component (a-1) to the component (a-2) is equal to or greater than 0.25 but equal to or less than 5.2, a polyamide copolymer having flexibility equal to that of nylon 12 and externally plasticized nylon 12 is obtained. When the ratio is equal to or greater than 0.25, the polyamide copolymer has sufficient flexibility. When the ratio is equal to or less than 5.2, the polyamide copolymer has sufficient heat resistance.

In light of strength, the polyamide copolymer (A) has a melt viscosity at 250° C. of preferably 5 Pa·s or greater and particularly preferably 10 Pa·s or greater. The melt viscosity is preferably equal to or less than 500 Pa·s.

In polycondensation of the polymerized fatty acid (a-1), azelaic acid and/or sebacic acid (a-2), and hexamethylenediamine (a-3), the melting point of the salt of the polymerized fatty acid and hexamethylenediamine and the melting point of the salt of azelaic acid and/or sebacic acid and hexamethylenediamine are relatively low. Further, the polycondensation rate is relatively high. Therefore, it is not necessary to add water to the system for the purpose of acceleration of a ring-opening polymerization reaction and uniform polymerization. For the polycondensation, a pressure reaction vessel is unnecessary. It is also not necessary that a prepolymer is previously polymerized.

In a preferred embodiment, the polymerized fatty acid (a-1), azelaic acid and/or sebacic acid (a-2), and hexamethylenediamine (a-3) are added into a reaction vessel in which the atmosphere is substituted with nitrogen. At that time, the weight ratio of (a-1) to (a-2) is set to be 0.25 to 5.2. Further, the amino group is caused to be substantially equivalent to the carboxyl group. Polycondensation is performed in the presence of a predetermined amount of a molecular weight modifier and a small amount of a polycondensation catalyst. In the polycondensation, the temperature in the vessel is set to be equal to or higher than 200° C. but equal to or lower than 280° C. The reaction is allowed to proceed at this temperature for 1 to 3 hours and is further allowed to proceed under a reduced pressure of about 160 mmHg for 0.5 to 2 hours. An example of the molecular weight modifier is stearic acid. Examples of the catalyst include phosphoric acid catalysts such as phosphoric acid, metaphosphatic acid, and polyphosphoric acid.

For producing the polyamide elastomer, various methods can be used. First, a polyamide oligomer is synthesized. A polyoxyalkylene glycol and a dicarboxylic acid are added to the oligomer, heated, and highly polymerized under a reduced pressure to obtain a polyether-ester amide. A polyamide forming monomer, a polyoxyalkylene glycol, and a dicarboxylic acid may be added together, heated, and then highly polymerized under a reduced pressure.

A stabilizer such as an antioxidant, an anti-thermal decomposition agent, and an ultraviolet absorber can be added to the polyamide copolymer (A). Examples of heat stabilizers include hindered phenols such as 4',4-bis(2,6-di-t-butylphenol), 1,3,5-trimethyl-2,4,6-tris(3,5-di-t-butyl-4-hydroxybenzyl)benzene, tetrakis-[methylene-3-(3,5-di-t-butyl-4-hydroxyphenyl)propionate]methane, and N,N'-hexamethylene-bis(3,5-di-t-butyl-4-hydroxycinnamic amide); aromatic amines such as N,N'-bis(β-naphthyl)-P-phenylenediamine and 4,4'-bis(4-α,α-dimethylbenzyl)diphenylamine; sulfur compounds such as dilauryl thiodipropionate; phosphorus compounds; alkaline earth metal oxide; nickel salts of Schiff bases; cuprous iodide; and potassium iodide.

Examples of light stabilizers include substituted benzophenones; benzotriazoles; and piperidine compounds such as bis(2,2,6,6-tetramethyl-4-piperidine)sebacate and 4-benzoyloxy-2,2,6,6-tetramethylpiperidine.

According to need, a reinforcing agent, a filler, a lubricant, a mold release agent, a plasticizer, a flame retardant, a hydrolysis modifier, and the like are added to the polyamide copolymer (A).

In light of fluidity of the resin composition of the cover 8, the polyamide copolymer (A) has a melt flow rate (230° C., 2.16 kg load) of preferably 10 g/10 min or greater, more preferably 20 g/10 min or greater, and particularly preferably 30 g/10 min or greater. In light of durability of the golf ball 2, the melt flow rate is preferably equal to or less than 2,000 g/10 min, more preferably equal to or less than 1,800 g/10 min, and particularly preferably equal to or less than 1,500 g/10 min.

In light of suppression of spin, the polyamide copolymer (A) has a flexural modulus of preferably 400 MPa or greater, more preferably 410 MPa or greater, and particularly preferably 420 MPa or greater. In light of feel at impact, the flexural modulus is preferably equal to or less than 1,000 MPa, more preferably equal to or less than 950 MPa, and particularly preferably equal to or less than 900 MPa.

Specific examples of the polyamide copolymer (A) include trade names "PA-30R", "PA-90R", "PA-50R", "PA-30L", "PA-40L", and "PA-50L", manufactured by Fuji Kasei Kogyo, Co., Ltd.

The component (B) includes at least one member selected from the group consisting of:

(b-1) a binary copolymer formed with an olefin and an α,β-unsaturated carboxylic acid having 3 to 8 carbon atoms, (b-2) a metal ion neutralized product of a binary copolymer formed with an olefin and an α,β-unsaturated carboxylic acid having 3 to 8 carbon atoms, (b-3) a ternary copolymer formed with: an olefin; an α,β-unsaturated carboxylic acid having 3 to 8 carbon atoms; and an α,β-unsaturated carboxylate ester, and (b-4) a metal ion neutralized product of a ternary copolymer formed with: an olefin; an α,β-unsaturated carboxylic acid having 3 to 8 carbon atoms; and an α,β-unsaturated carboxylate ester.

The component (B) can increase the fluidity of the resin composition of the cover 8.

The resin composition of the cover 8 more preferably contains at least either one of the binary copolymer (b-1) or the metal ion neutralized product of the binary copolymer (b-2), and at least either one of the ternary copolymer (b-3) or the metal ion neutralized product of the ternary copolymer (b-4). The resin composition of the cover 8 particularly preferably contains the metal ion neutralized product of the binary copolymer (b-2) and the metal ion neutralized product of the ternary copolymer (b-4).

The component (b-1) is a binary copolymer formed with an olefin and an α,β-unsaturated carboxylic acid having 3 to 8 carbon atoms. The carboxyl groups in the binary copolymer are not neutralized.

The component (b-2) is a binary copolymer formed with an olefin and an α,β-unsaturated carboxylic acid having 3 to 8 carbon atoms. At least some of the carboxyl groups in the binary copolymer are neutralize with metal ion. The component (b-2) is a binary ionomer resin.

The component (b-3) is a ternary copolymer formed with: an olefin; an α,β-unsaturated carboxylic acid having 3 to 8 carbon atoms; and an α,β-unsaturated carboxylate ester. The carboxyl groups in the ternary copolymer are not neutralized.

The component (b-4) is a ternary copolymer formed with: an olefin; an α,β-unsaturated carboxylic acid having 3 to 8 carbon atoms; and an α,β-unsaturated carboxylate ester. At least some of the carboxyl groups in the ternary copolymer are neutralized with metal ion. The component (b-4) is a ternary ionomer resin.

Example of the olefin components in the binary copolymers and the ternary copolymers include ethylene, propylene, butene, pentene, hexene, heptene, and octene. Preferable olefins are ethylene and propylene. Examples of the α,β-unsaturated carboxylic acids in the binary copolymers and the ternary copolymers include acrylic acid, methacrylic acid, fumaric acid, maleic acid, and crotonic acid. Preferable α,β-unsaturated carboxylic acids are acrylic acid and methacrylic acid. Examples of the esters in the ternary copolymers include acrylic acid esters, methacrylic acid esters, fumaric acid esters, and maleic acid esters. Preferable esters are acrylic acid esters and methacrylic acid esters.

As the component (b-1), a binary copolymer of ethylene and (meth)acrylic acid is preferred. As the component (b-2), a metal ion neutralized product of an ethylene-(meth)acrylic acid binary copolymer is preferred. As the component (b-3), a ternary copolymer of ethylene, (meth)acrylic acid, and a (meth)acrylic acid ester is preferred. As the component (b-4), a metal ion neutralized product of a ternary copolymer of ethylene, (meth)acrylic acid, and a (meth)acrylic acid ester is preferred. Here, (meth)acrylic acid means acrylic acid and/or methacrylic acid.

The contents of the α,β-unsaturated carboxylic acid components in the binary copolymer (b-1) and the ternary copolymer (b-3) are preferably equal to or greater than 4% by weight and particularly preferably equal to or greater than 5% by weight. The contents are preferably equal to or less than 30% by weight and particularly preferably equal to or less than 25% by weight.

In light of fluidity of the resin composition of the cover 8, the binary copolymer (b-1) and the ternary copolymer (b-3) have melt flow rates (190° C., 2.16 kg load) of preferably 5 g/10 min or greater, more preferably 10 g/10 min or greater, and particularly preferably 15 g/10 min or greater. In light of durability of the golf ball 2, the melt flow rates are preferably equal to or less than 1700 g/10 min, more preferably equal to or less than 1500 g/10 min, and particularly preferably equal to or less than 1300 g/10 min.

Specific examples of the binary copolymer (b-1) include ethylene-methacrylic acid copolymers manufactured by Du Pont-MITSUI POLYCHEMICALS Co., Ltd. (trade names "NUCREL N1050H", "NUCRELN2050H", "NUCRELAN4318", "NUCRELN1110H", and "NUCREL N0200H"). Another specific example of the binary copolymer (b-1) is an ethylene-acrylic acid copolymer manufactured by the Dow Chemical Company (trade name "PRIMACOR 45980I").

Specific examples of the ternary copolymer (b-3) include trade names "NUCREL AN4318" and "NUCREL AN4319", manufactured by Du Pont-MITSUI POLYCHEMICALS Co., Ltd.; trade name "NUCREL AE" manufactured by E.I. du Pont de Nemours and Company; and trade names "PRIMACORAT310" and "PRIMACORAT320", manufactured by the Dow Chemical Company. The binary copolymer (b-1) and the ternary copolymer (b-3) may be used in combination.

From the standpoint that the cover 8 having an appropriate hardness is obtained, the content of the α,β-unsaturated carboxylic acid component in the binary ionomer resin (b-2) is preferably equal to or greater than 15% by weight, more preferably equal to or greater than 16% by weight, and particularly preferably equal to or greater than 17% by weight. In light of feel at impact, the content is preferably equal to or less than 30% by weight and particularly preferably equal to or less than 25% by weight.

In light of resilience and durability of the golf ball 2, the degree of neutralization of the carboxyl groups in the binary ionomer resin (b-2) is preferably equal to or greater than 15 mol % and particularly preferably equal to or greater than 20 mol %. In light of fluidity of the resin composition, the degree of neutralization is preferably equal to or less than 90 mol % and particularly preferably equal to or less than 85 mol %. The degree of neutralization N is calculated on the basis of the following mathematical formula.

$$N=(M1/M2)\cdot 100$$

In the mathematical formula, M1 denotes the number of moles of neutralized carboxyl groups, and M2 denotes the total number of moles of the carboxyl groups.

Examples of metal ions for use in neutralization include monovalent metal ions such as sodium ion, potassium ion, and lithium ion; bivalent metal ions such as magnesium ion, calcium ion, zinc ion, barium ion, and cadmium ion; trivalent metal ions such as aluminum ion; tin ion; and zirconium ion. A mixture of a binary ionomer resin neutralized with sodium and a binary ionomer resin neutralized with zinc is particularly suitable for the cover 8.

Specific examples of the binary ionomer resin (b-2) include trade names "Himilan 1555", "Himilan 1557", "Himilan 1605", "Himilan 1706", "Himilan 1707", "Himilan AM7311", and "Himilan AM7329", manufactured by Du Pont-MITSUI POLYCHEMICALS Co., LTD.; trade names "Surlyn 8945", "Surlyn 9945", "Surlyn 8140", "Surlyn 8150", "Surlyn 9120", "Surlyn 9150", "Surlyn 6910", "Surlyn 6120", "Surlyn 7930", "Surlyn 7940", and "Surlyn AD8546", manufactured by E.I. du Pont de Nemours and Company; and trade names "Iotek 8000", "Iotek 8030", "Iotek 7010", and "Iotek 7030", manufactured by ExxonMobil Chemical Corporation. Two or more types of binary ionomer resins may be used in combination.

In light of suppression of spin, the binary ionomer resin (b-2) has a flexural rigidity of preferably 140 MPa or greater, more preferably 150 MPa or greater, and particularly preferably 160 MPa or greater. In light of durability of the golf ball 2, the flexural rigidity is preferably equal to or less than 550 MPa, more preferably equal to or less than 500 MPa, and particularly preferably equal to or less than 450 MPa.

In light of fluidity of the resin composition of the cover 8, the binary ionomer resin (b-2) has a melt flow rate (190° C., 2.16 kg load) of preferably 0.1 g/10 min or greater, more preferably 0.5 g/10 min or greater, and particularly preferably 1.0 g/10 min or greater. In light of durability of the golf ball 2, the melt flow rate is preferably equal to or less than 30 g/10 min, more preferably equal to or less than 20 g/10 min, and particularly preferably equal to or less than 15 g/10 min.

In light of suppression of spin, the binary ionomer resin (b-2) has a Shore D hardness of preferably 50 or greater, more preferably 55 or greater, and particularly preferably 60 or greater. In light of durability of the golf ball 2, the Shore D hardness is preferably equal to or less than 75, more preferably equal to or less than 73, and particularly preferably equal to or less than 70. The Shore D hardness of the binary ionomer resin (b-2) is measured by the same method as that for the hardness H2 of the mid layer 6.

The content of the α,β-unsaturated carboxylic acid in the ternary ionomer resin (b-4) is preferably equal to or greater than 2% by weight and particularly preferably equal to or greater than 3% by weight. The content is preferably equal to or less than 30% by weight and particularly preferably equal to or less than 25% by weight.

In light of resilience and durability of the golf ball 2, the degree of neutralization of the carboxyl groups in the ternary ionomer resin (b-4) is preferably equal to or greater than 20 mol % and particularly preferably equal to or greater than 30 mol %. In light of fluidity of the resin composition, the degree of neutralization is preferably equal to or less than 90 mol % and particularly preferably equal to or less than 85 mol %. The degree of neutralization N is calculated on the basis of the following mathematical formula.

$$N=(M1/M2)\cdot 100$$

In the mathematical formula, M1 denotes the number of moles of neutralized carboxyl groups, and M2 denotes the total number of moles of the carboxyl groups.

Examples of metal ions for use in neutralization include monovalent metal ions such as sodium ion, potassium ion, and lithium ion; bivalent metal ions such as magnesium ion, calcium ion, zinc ion, barium ion, and cadmium ion; trivalent metal ions such as aluminum ion; tin ion; and zirconium ion. In light of durability and low-temperature durability of the golf ball 2, a ternary ionomer resin neutralized with zinc is preferred.

Specific examples of the ternary ionomer resin (b-4) include trade names "Himilan AM7327", "Himilan 1855", "Himilan 1856", and "Himilan AM7331", manufactured by Du Pont-MITSUI POLYCHEMICALS Co., LTD.; trade names "Surlyn 6320", "Surlyn 8120", "Surlyn 8320", "Surlyn 9320", and "Surlyn 9320W", manufactured by E.I. du Pont de Nemours and Company; and trade names "Iotek 7510" and "Iotek 7520", manufactured by ExxonMobil Chemical Corporation. Two or more types of ternary ionomer resins may be used in combination.

In light of suppression of spin, the ternary ionomer resin (b-4) has a flexural rigidity of preferably 10 MPa or greater, more preferably 11 MPa or greater, and particularly preferably 12 MPa or greater. In light of durability of the golf ball 2, the flexural rigidity is preferably equal to or less than 100 MPa, more preferably equal to or less than 97 MPa, and particularly preferably equal to or less than 95 MPa.

In light of fluidity of the resin composition of the cover 8, the ternary ionomer resin (b-4) has a melt flow rate (190° C., 2.16 kg load) of preferably 0.1 g/10 min or greater, more preferably 0.3 g/10 min or greater, and particularly preferably 0.5 g/10 min or greater. In light of durability of the golf ball 2, the melt flow rate is preferably equal to or less than 20 g/10 min, more preferably equal to or less than 15 g/10 min, and particularly preferably equal to or less than 10 g/10 min.

In light of resilience performance of the golf ball 2, the ternary ionomer resin (b-4) has a Shore D hardness of preferably 20 or greater, more preferably 25 or greater, and particularly preferably 30 or greater. In light of durability of the golf ball 2, the Shore D hardness is preferably equal to or less than 70, more preferably equal to or less than 65, and particularly preferably equal to or less than 60. The Shore D hardness of the ternary ionomer resin (b-4) is measured by the same method as that for the hardness H2 of the mid layer 6.

The resin composition of the cover 8 may contain a polyamide resin composition (C) together with the components (A) and (B). The polyamide resin composition (C) contributes to the rigidity of the cover 8. In the golf ball 2 that includes the cover 8 containing the polyamide resin composition (C), an outer-hard/inner-soft structure can be achieved. In the golf ball 2, spin can be suppressed.

The polyamide resin composition (C) contains:

(c-1) a polyamide resin, and (c-2) a resin having at least one functional group selected from the group consisting of a hydroxyl group, a carboxyl group, an anhydride group, a sulfonic group, and an epoxy group (including a glycidyl group).

The polyamide resin (c-1) is a polymer having a plurality of amide bonds (—NH—CO—) in the main chain. The component (c-2) can contribute to the impact resistance of the cover 8.

The polyamide resin (c-1) can be produced by ring-opening polymerization of a lactam. Examples of the lactam include ε-caprolactam, undecanelactam, and lauryl lactam. The polyamide resin (c-1) can also be produced by a reaction of a diamine component and a dicarboxylic acid component.

Examples of the diamine component include hexamethylenediamine, nonanediamine, methylpentadiamine, p-phenylenediamine, m-phenylenediamine, p-xylenediamine, and m-xylenediamine. Example of the dicarboxylic acid component include adipic acid, sebacic acid, terephthalic acid, and isophthalic acid.

A polyamide resin (c-1) in which a polymerized fatty acid is not used as a dicarboxylic acid component is preferred. Examples of a preferable polyamide resin (c-1) include aliphatic polyamides such as polyamide 6, polyamide 11, polyamide 12, polyamide 66, polyamide 610, polyamide 6T, polyamide 6I, polyamide 9T, polyamide M5T, and polyamide 612; and aromatic polyamides such as poly-p-phenylene terephthalic amide and poly-m-phenylene isophthalic amide. Aliphatic polyamides are preferred, and polyamide 6, polyamide 11, polyamide 12, and polyamide 66 are particularly preferred. Two or more types of polyamide resins may be used in combination.

Specific examples of the polyamide resin (c-1) include trade names "Rilsan BESN TL", "Rilsan BESN P20TL", "Rilsan BESN P40 TL", "Rilsan MB3610", "Rilsan BMF O", "Rilsan BMN O", "Rilsan BMN OTLD", "Rilsan BMN BK TLD", "Rilsan BMN P20 D", and "Rilsan BMN P40 D", manufactured by Arkema Inc.; trade names "Novamid 1010C2", "Novamid 1011CH5", "Novamid 1013C5", "Novamid 1010N2", "Novamid 1010N2-2", "Novamid 1010N2-1ES", "Novamid 1013G (H) 10-1", "Novamid 1013G (H) 15-1", "Novamid 1013G (H) 20-1", "Novamid 1013G (H) 30-1", "Novamid 1013(H) 45-1", "Novamid 1015G33", "Novamid 1015 GH35", "Novamid 1015GSTH", "Novamid 1010GN2-30", "Novamid 1015F2", "Novamid ST220", "Novamid ST145", "Novamid 3010SR", "Novamid 3010N5-SL4", "Novamid 3021G (H)30", and "Novamid 3010GN30", manufactured by DSM Engineering Plastics; and trade names "Amilan CM1007", "Amilan CM1017", "Amilan CM1017XL3", "Amilan CM1017K", "Amilan CM1026", "Amilan CM3007", "Amilan CM3001-N", "Amilan CM3006", "Amilan CM3301L", "Amilan CM1011G-15", "Amilan CM1001G-15", "Amilan CM1001G-20", "Amilan CM1011G-30", "Amilan CM1016G-30", "Amilan CM1011G-45", "Amilan CM1016G-45N", "Amilan CM1001R", "Amilan CM3001G-15", "Amilan CM3006G-15", "Amilan CM3001G-30", "Amilan CM3006G-30", "Amilan CM3001G-45", "Amilan CM3006G-45", "Amilan CM3511G33", "Amilan CM3511G50", "Amilan CM3511G60", "Amilan CM3516G33", "Amilan CM3501G50", "Amilan EA1R21G33", "Amilan CM3001R", "Amilan CM1014-V0", "Amilan CM3004-V0", "Amilan CM3304-V0", "Amilan CM3004G-15", "Amilan CM3004G-20", "Amilan CM3004G-30", "Amilan HF3074G-15", "Amilan HF3074G-30", "Amilan HF3064G15", "Amilan HF3064G30", "Amilan CM1023G1000", "Amilan CM1003G30", "Amilan CM3003G1000", "Amilan CM3003G30", "Amilan CM3903GX01", "Amilan U121", "Amilan U141", "Amilan U127GX07", "Amilan U320", "Amilan U328", and "Amilan U625×21", manufactured by Toray Industries Inc.

Hereinafter, the resin (c-2) having at least one functional group selected from the group consisting of a hydroxyl group, a carboxyl group, an anhydride group, a sulfonic group, and an epoxy group (including a glycidyl group) is referred to as "functional group-containing resin". In the functional group-containing resin (c-2) the aforementioned binary copolymer (b-1), the aforementioned metal ion neutralized product of the binary copolymer (b-2), the aforementioned ternary copolymer (b-3), and the aforementioned metal ion neutralized product of the ternary copolymer (b-4) are not included.

Preferably, the functional group-containing resin (c-2) is a thermoplastic elastomer. Examples of the thermoplastic elastomer include thermoplastic polyolefin elastomers, thermoplastic polyester elastomers, thermoplastic polyamide elastomers, thermoplastic polyurethane elastomers, and thermoplastic styrene elastomers. Thermoplastic polyolefin elastomers and thermoplastic styrene elastomers are preferred.

A preferable thermoplastic polyolefin elastomer contains an ethylene component. Examples of thermoplastic polyolefin elastomers include ethylene-glycidyl(meth)acrylate copolymers, ethylene-(meth)acrylic acid ester-glycidyl (meth)acrylate copolymers, and ethylene-glycidyl (meth) acrylate-vinyl acetate copolymers.

A preferable thermoplastic styrene elastomer is a hydrogenated product of a block copolymer composed of a polystyrene block and a block having a conjugated diene compound as a main body thereof. In the hydrogenated product, hydrogen is added to at least some of unsaturated bonds derived from the conjugated diene compound. Examples of thermoplastic styrene elastomers include a hydrogenated product (SEBS) of a styrene-ethylene/butylene-styrene block copolymer in which 1,3-butadiene is used as a conjugated diene compound, and a hydrogenated product (SEPS) of a styrene-ethylene/propylene-styrene block copolymer in which 2-methyl-1,3-butadiene is used as a conjugated diene compound.

Specific examples of thermoplastic polyolefin elastomers include trade name "LOTARDERAX8840" manufactured by Arkema Inc., trade name "ARUFON UG-4030" manufactured by Toagosei Co., Ltd., and trade name "Bond Fast E" manufactured by Sumitomo Chemical Co., Ltd. Specific examples of thermoplastic styrene elastomers include trade names "Tuftec M1913" and "Tuftec M1943" manufactured by Asahi Kasei Corporation; trade name "FUSABOND NM052D" manufactured by E.I. du Pont de Nemours and Company; and trade name "Dynaron 4630P" manufactured by JSR Corporation.

A specific example of the polyamide resin composition (C) is trade name "Novamid ST120" manufactured by Mitsubishi Engineering-Plastics Company.

In light of fluidity of the resin composition of the cover 8, the polyamide resin composition (C) has a melt flow rate (240° C.×2.16 kg load) of preferably 5.0 g/10 min or greater, more preferably 6.0 g/10 min or greater, and particularly preferably 7.0 g/10 min or greater. In light of durability of the golf ball 2, the melt flow rate is preferably equal to or less than 150 g/10 min, more preferably equal to or less than 120 g/10 min, and particularly preferably equal to or less than 110 g/10 min.

In light of suppression of spin, the polyamide resin composition (C) has a flexural modulus of preferably 500 MPa or greater, more preferably 520 MPa or greater, and particularly preferably 550 MPa or greater. In light of feel at impact and durability of the golf ball 2, the flexural modulus is preferably equal to or less than 4000 MPa, more preferably equal to or less than 3500 MPa, and particularly preferably equal to or less than 3000 MPa.

The resin composition of the cover 8 may include a white pigment such as titanium dioxide, a pigment such as a blue pigment, a dispersant, an anti-aging agent, an ultraviolet absorber, a light stabilizer, a fluorescent material, a fluorescent brightener, and the like. In light of adhesion to the mid layer 6, the mark layer, and the paint layer, preferably, the resin composition of the cover 8 does not contain any low-molecular-weight material such as a fatty acid and a fatty acid metal salt.

When the base resin of the resin composition of the cover 8 is composed of the components (A) and (B), the proportion of the component (A) to the total base resin is preferably equal to or greater than 10% by weight but equal to or less than 80% by weight, more preferably equal to or greater than 15% by weight but equal to or less than 60% by weight, and particularly preferably equal to or greater than 25% by weight but equal to or less than 60% by weight. In the resin composition, the proportion of the component (B) to the total base resin is preferably equal to or greater than 20% by weight but equal to or less than 90% by weight, more preferably equal to or greater than 40% by weight but equal to or less than 85% by weight, and particularly preferably equal to or greater than 40% by weight but equal to or less than 75% by weight.

When the base resin of the resin composition of the cover 8 is composed of the components (A), (B), and (C), the proportion of the component (A) to the total base resin is preferably equal to or greater than 1% by weight but equal to or less than 70% by weight and particularly preferably equal to or greater than 5% by weight but equal to or less than 50% by weight. In the resin composition, the proportion of the component (B) to the total base resin is preferably equal to or greater than 15% by weight but equal to or less than 65% by weight and particularly preferably equal to or greater than 20% by weight but equal to or less than 60% by weight. In the resin composition, the proportion of the component (C) to the total base resin is preferably equal to or greater than 15% by weight but equal to or less than 60% by weight and particularly preferably equal to or greater than 20% by weight but equal to or less than 60% by weight. The weight proportion of the component (C) to the component (A) is preferably equal to or greater than 1% but equal to or less than 15% and particularly preferably equal to or greater than 5% but equal to or less than 14%.

In light of moldability, the resin composition of the cover 8 has a melt flow rate (240° C.×2.16 kg) of preferably 10 g/10 min or greater, more preferably 15 g/10 min or greater, and particularly preferably 18 g/10 min or greater. The melt flow rate is preferably equal to or less than 100 g/10 min, more preferably equal to or less than 70 g/10 min, and particularly preferably equal to or less than 40 g/10 min.

In light of suppression of spin, the cover 8 has a Shore D hardness H3 of preferably 66 or greater and particularly preferably 67 or greater. In light of durability of the golf ball 2, the hardness H3 is preferably equal to or less than 75, more preferably equal to or less than 74, and particularly preferably equal to or less than 73. The hardness H3 is measured by the same method as that for the hardness H2 of the mid layer 6.

In light of suppression of spin, the resin composition of the cover 8 has a flexural modulus of preferably 350 MPa or greater, more preferably 370 MPa or greater, and particularly preferably 400 MPa or greater. In light of feel at impact of the golf ball 2, the flexural modulus is preferably equal to or less than 1000 MPa, more preferably equal to or less than 900 MPa, and particularly preferably equal to or less than 800 MPa.

The cover 8 has a thickness of preferably 0.3 mm or greater but 1.5 mm or less. The cover 8 having a thickness of 0.3 mm or greater can easily be formed. In this respect, the thickness is particularly preferably equal to or greater than 0.4 mm. In the golf ball 2 that includes the cover 8 having a thickness of 1.5 mm or less, an outer-heavy/inner-light structure can be achieved. In this respect, the thickness is more preferably equal to or less than 1.0 mm and particularly preferably equal to or less than 0.8 mm.

For forming the cover 8, known methods such as injection molding, compression molding, and the like can be used. When forming the cover 8, the dimples 10 are formed by pimples present on the cavity face of a mold. The cover 8 may have two or more layers.

The Shore D hardness H3 of the cover 8 is greater than the Shore D hardness H2 of the mid layer 6. This cover 8 can achieve an outer-hard/inner-soft structure of the golf ball 2. The golf ball 2 has excellent flight performance and feel at impact. The difference (H3−H2) is preferably equal to or greater than 4 and particularly preferably equal to or greater than 6. The difference (H3−H2) is preferably equal to or less than 20.

The sum (W2+W3) of the weight W2 of the mid layer 6 and the weight W3 of the cover 8 is preferably equal to or greater than 8.4 g but equal to or less than 12.0 g. In the golf ball 2 in which the sum (W2+W3) is equal to or greater than 8.4 g, an outer-heavy/inner-light structure can be achieved. In this respect, the sum (W2+W3) is more preferably equal to or greater than 8.7 g and particularly preferably equal to or greater than 9.0 g. In the golf ball 2 in which the sum (W2+W3) is equal to or less than 12.0 g, the core 4 is sufficiently large. The large core 4 can achieve excellent resilience performance. In this respect, the sum (W2+W3) is more preferably equal to or less than 11.0 g and particularly preferably equal to or less than 10.0 g.

The sum (V2+V3) of the volume V2 of the mid layer 6 and the volume V3 of the cover 8 is preferably equal to or less than 10 $cm^3$. In the golf ball 2 in which the sum (V2+V3) is equal to or less than 10 $cm^3$, the core 4 is sufficiently large. The large core 4 can achieve excellent resilience performance. In this respect, the sum (V2+V3) is more preferably equal to or less than 9.5 $cm^3$ and particularly preferably equal to or less than 9.0 $cm^3$. The sum (V2+V3) is preferably equal to or greater than 7.0 $cm^3$.

EXAMPLES

Example 1

A rubber composition was obtained by kneading 100 parts by weight of a high-cis polybutadiene (trade name "BR-730", manufactured by JSR Corporation), 27.0 parts by weight of zinc diacrylate, 5 parts by weight of zinc oxide, an appropriate amount of barium sulfate, 0.2 parts by weight of 2-naphthalenethiol, and 0.8 parts by weight of dicumyl peroxide. This rubber composition was placed into a mold including upper and lower mold halves each having a hemispherical cavity, and heated at 170° C. for 25 minutes to obtain a core with a diameter of 39.2 mm. The amount of barium sulfate was adjusted such that the weight of a golf ball is 45.6 g.

A resin composition was obtained by kneading 40 parts by weight of an ionomer resin (the aforementioned "Himilan AM7329"), 34 parts by weight of another ionomer resin (the aforementioned "Himilan AM7337"), 26 parts by weight of a styrene block-containing thermoplastic elastomer (the aforementioned "Rabalon T3221C"), and 32 parts by weight of tungsten powder with a twin-screw kneading extruder. The core was placed into a mold. The core was covered with the resin composition by injection molding to form a mid layer with a thickness of 1.0 mm.

A resin composition was obtained by kneading 60 parts by weight of a polyamide copolymer (the aforementioned "PA-30L"), 20 parts by weight of an ionomer resin (the aforementioned "Himilan AM7337"), 20 parts by weight of another ionomer resin (the aforementioned "Himilan AM7329"), 3 parts by weight of titanium dioxide, and 0.04 parts by weight of ultramarine blue with a twin-screw kneading extruder. The sphere consisting of the core and the mid layer was placed into a final mold having a large number of pimples on its cavity face. The sphere was covered with the resin composition by injection molding to form a cover with a thickness of 0.8 mm. Dimples having a shape that is the inverted shape of the pimples were formed on the cover. A clear paint including a two-component curing type polyurethane as a base material was applied to this cover to obtain a golf ball of Example 1 with a diameter of 42.8 mm.

Examples 2 to 13 and Comparative Examples 1 and 3 to 5

Golf balls of Examples 2 to 13 and Comparative Examples 1 and 3 to 5 were obtained in the same manner as Example 1, except the specifications of the core, the mid layer, and the cover were changed. It should be noted that in Comparative Example 5, the resin composition of the cover did not flow, and thus the cover was not formed.

Comparative Example 2

A rubber composition was obtained by kneading 100 parts by weight of a high-cis polybutadiene (the aforementioned "BR-730"), 21.5 parts by weight of zinc diacrylate, 5 parts by weight of zinc oxide, an appropriate amount of barium sulfate, 0.5 parts by weight of diphenyl disulfide, and 0.8 parts by weight of dicumyl peroxide. This rubber composition was placed into a mold including upper and lower mold halves each having a hemispherical cavity, and heated at 170° C. for 25 minutes to obtain a center with a diameter of 25.0 mm.

A rubber composition was obtained by kneading 100 parts by weight of a high-cis polybutadiene (the aforementioned "BR-730"), 33.0 parts by weight of zinc diacrylate, 5 parts by weight of zinc oxide, an appropriate amount of barium sulfate, 0.5 parts by weight of diphenyl disulfide, and 0.8 parts by weight of dicumyl peroxide. Half shells were formed from this rubber composition. The center was covered with two half shells. The center and the half shells were placed into a mold including upper and lower mold halves each having a hemispherical cavity, and heated at 170° C. for 25 minutes to obtain a core with a diameter of 39.6 mm. The core consists of the center and an envelope layer. The core was covered with a mid layer formed from a resin composition (i), in the same manner as Example 1. The mid layer was covered with a cover formed from a resin composition (d), in the same manner as Example 1. Further, a clear paint was applied to this cover in the same manner as Example 1, to obtain a golf ball of Comparative Example 2.

[Flight Distance]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec, and the distance from the launch point to the stop point of the golf ball was measured. The average value of data obtained by 10 measurements is shown in Tables 5 to 8 below.

[Durability Test]

A driver with a titanium head (trade name "XXIO", manufactured by SRI Sports Limited, shaft hardness: S, loft angle: 11.0°) was attached to a swing machine manufactured by Golf Laboratories, Inc. The golf ball was repeatedly hit under the condition of a head speed of 45 m/sec. The number of hits required to break the golf ball was counted. When the cover was not broken and the core or the mid layer was broken, the breakage was recognized through deformation of the golf ball or unusual sound at hit of the golf ball. An index of the average value of data obtained by 12 measurements is shown in Tables 5 to 8 below.

TABLE 1

Figure 3:
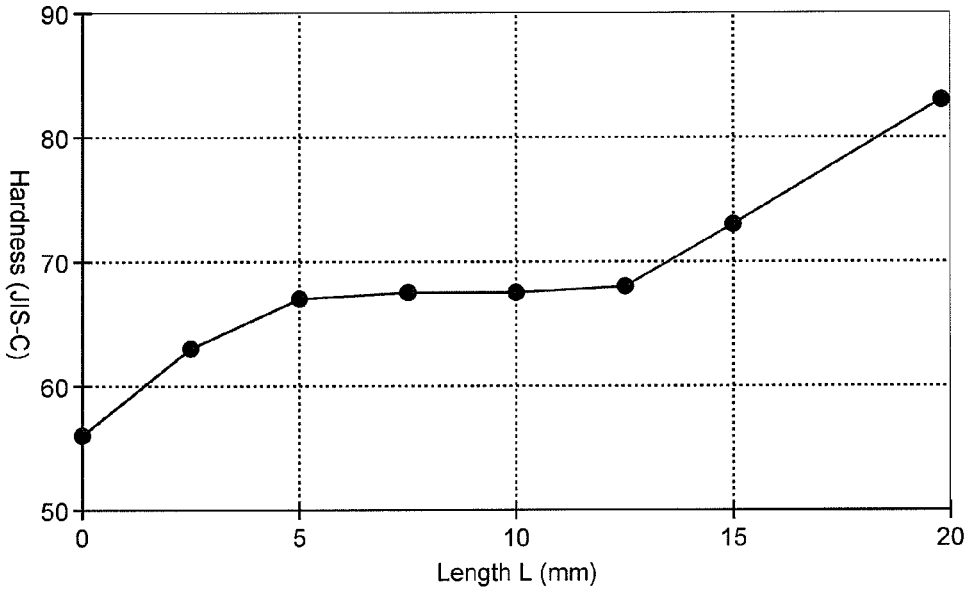
FIG. 3 is a graph showing a hardness distribution of a core of a golf ball according to Example 6 of the present invention.
Figure 4:
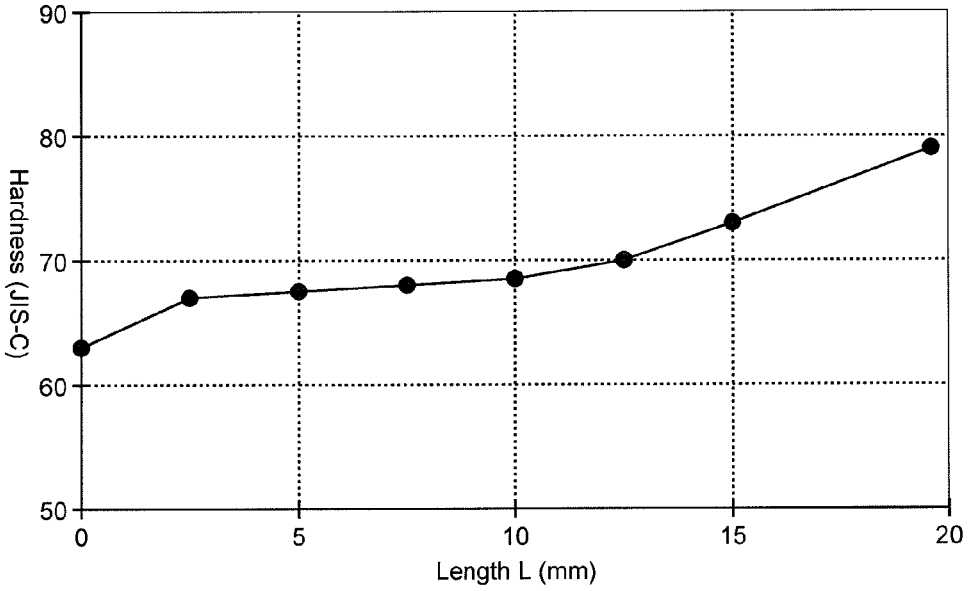
FIG. 4 is a graph showing a hardness distribution of a core of a golf ball according to Comparative Example 1.
Figure 5:
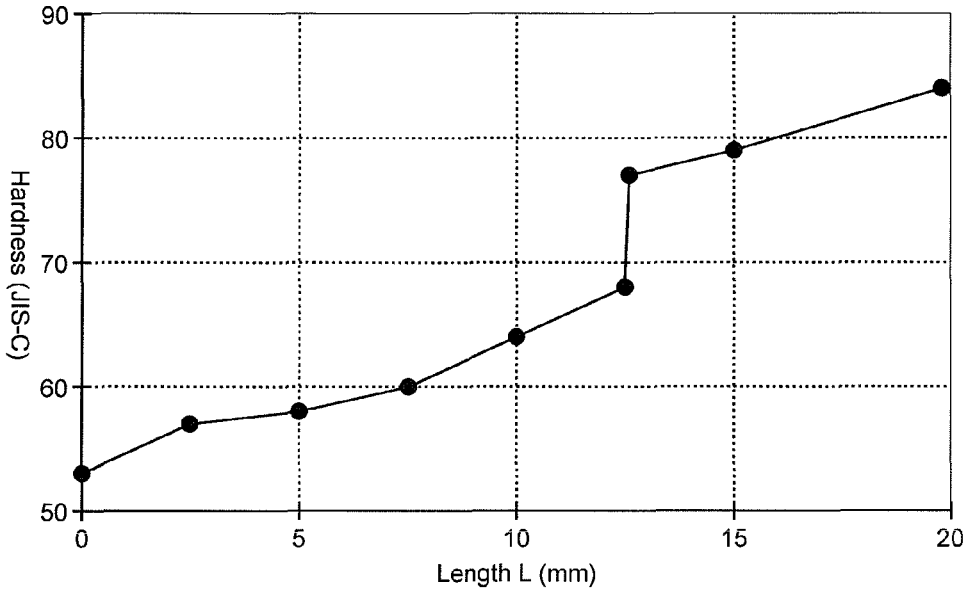
FIG. 5 is a graph showing a hardness distribution of a core of a golf ball according to Comparative Example 2.

| Specifications of Core (parts by weight) | | | | | | | | |
|---|---|---|---|---|---|---|---|---|
| Type | | (1) | (2) | (3) | (4) | (5) | (6) | (7) |
| Polybutadiene | | 100 | 100 | 100 | 100 | 100 | 100 | 100 |
| Zinc diacrylate | | 27 | 27 | 27 | 27 | 28 | 21.5 | 33.0 |
| Zinc oxide | | 5 | 5 | 5 | 5 | 5 | 5 | 5 |
| Barium sulfate | | * | * | * | * | * | * | * |
| 2-naphthalenethiol | | 0.2 | 0.2 | 0.2 | 0.2 | — | — | — |
| Diphenyl disulfide | | — | — | — | — | 0.5 | 0.5 | 0.5 |
| Dicumyl peroxide | | 0.8 | 0.8 | 0.8 | 0.8 | 0.8 | 0.8 | 0.8 |
| Crosslinking temperature (° C.) | | 170 | 170 | 170 | 170 | 170 | 170 | 170 |
| Crosslinking time (min) | | 25 | 25 | 25 | 25 | 25 | 25 | 25 |
| Diameter (mm) | | 39.2 | 39.2 | 39.2 | 39.6 | 39.2 | 25.0 | 39.6 |
| Specific gravity | | 1.090 | 1.107 | 1.116 | 1.091 | 1.116 | 1.116 | 1.116 |
| Hardness JIS-C | Ho | 56.0 | 56.0 | 56.0 | 56.0 | 63.0 | 53.0 | |
| | H(2.5) | 63.0 | 63.0 | 63.0 | 63.0 | 67.0 | 57.0 | |
| | H(5.0) | 67.0 | 67.0 | 67.0 | 67.0 | 67.5 | 58.0 | |
| | H(7.5) | 67.5 | 67.5 | 67.5 | 67.5 | 68.0 | 60.0 | |
| | H(10.0) | 67.5 | 67.5 | 67.5 | 67.5 | 68.5 | 64.0 | |
| | H(12.5) | 68.0 | 68.0 | 68.0 | 68.0 | 70.0 | 68.0 | |
| | H(12.6) | — | — | — | — | — | 77.0 | |
| | H(15.0) | 73.0 | 73.0 | 73.0 | 73.0 | 73.0 | 79.0 | |
| | Hs | 83.0 | 83.0 | 83.0 | 83.0 | 79.0 | 84.0 | |
| | Graph | FIG. 2 | FIG. 2 | FIG. 2 | FIG. 3 | FIG. 4 | FIG. 5 | |

* Appropriate amount

The details of the compounds listed in Table 1 are as follows.

2-naphthalenethiol: Tokyo Chemical Industry Co., Ltd.

Diphenyl disulfide: Sumitomo Seika Chemicals Co., Ltd.

Dicumyl peroxide: NOF Corporation

TABLE 2

| Composition of Mid Layer (parts by weight) | | |
|---|---|---|
| Type | (i) | (ii) |
| Himilan AM7329 | 40 | 40 |
| Himilan AM7337 | 34 | 34 |
| Rabalon T3221C | 26 | 26 |
| Tungsten | 22 | 32 |
| Hardness H2 (Shore D) | 50 | 50 |
| Specific gravity | 1.14 | 1.23 |

TABLE 3

| Composition of Cover (parts by weight) | | | | | | |
|---|---|---|---|---|---|---|
| Type | (a) | (b) | (c) | (d) | (e) | (f) |
| PA-30L | 60 | 60 | — | — | — | — |
| PA-40L | — | — | 60 | 10 | 5 | 20 |
| Himilan AM7337 | 20 | 15 | 15 | 10 | 15 | 35 |
| Himilan AM7329 | 20 | 15 | 15 | 10 | 15 | 35 |
| Himilan AM7327 | — | 10 | 10 | 10 | 10 | 10 |
| HPF1000 | — | — | — | — | — | — |
| Novamid ST120 | — | — | — | 60 | 55 | — |
| Titanium dioxide | 3 | 3 | 3 | 3 | 3 | 3 |
| Ultramarine blue | 0.04 | 0.04 | 0.04 | 0.04 | 0.04 | 0.04 |
| Hardness H3 (Shore D) | 70 | 69 | 69 | 69 | 68 | 66 |
| Specific gravity | 1.02 | 1.02 | 1.02 | 1.04 | 1.03 | 0.99 |

TABLE 4

| Composition of Cover (parts by weight) | | | | | |
|---|---|---|---|---|---|
| Type | (g) | (h) | (i) | (j) | (k) |
| PA30L | — | — | — | — | — |
| PA40L | 40 | 30 | 50 | — | — |
| Himilan AM7337 | 25 | 10 | 10 | 50 | — |
| Himilan AM7329 | 25 | 10 | 10 | 50 | — |
| Himilan AM7327 | 10 | 10 | 10 | — | — |
| HPF1000 | — | — | — | — | 100 |
| Novamid ST120 | — | 40 | 20 | — | — |
| Titanium dioxide | 3 | 3 | 3 | 3 | 3 |
| Ultramarine blue | 0.04 | 0.04 | 0.04 | 0.04 | 0.04 |
| Hardness H3 (Shore D) | 68 | 70 | 70 | 64 | 54 |
| Specific gravity | 1.00 | 1.03 | 1.03 | 0.98 | 0.98 |

TABLE 5

| Results of Evaluation | | | | | | |
|---|---|---|---|---|---|---|
| | | Ex. 1 | Ex. 2 | Ex. 3 | Ex. 4 | Ex. 5 |
| Core | Type | (2) | (2) | (2) | (2) | (1) |
| | H(5.0) − Ho | 11.0 | 11.0 | 11.0 | 11.0 | 11.0 |
| | H(12.5) − H(5.0) | 1.0 | 1.0 | 1.0 | 1.0 | 1.0 |
| | Hs − H(12.5) | 15.0 | 15.0 | 15.0 | 15.0 | 15.0 |
| | Hs − Ho | 27.0 | 27.0 | 27.0 | 27.0 | 27.0 |
| Mid layer | Composition | (ii) | (ii) | (ii) | (ii) | (i) |
| | Hardness H2 (Shore D) | 50 | 50 | 50 | 50 | 50 |
| | Thickness (mm) | 1.0 | 1.0 | 1.0 | 1.0 | 1.0 |
| | Weight W2 (g) | 6.27 | 6.27 | 6.27 | 6.27 | 5.81 |

TABLE 5-continued

| Results of Evaluation | | | | | | |
|---|---|---|---|---|---|---|
| | | Ex. 1 | Ex. 2 | Ex. 3 | Ex. 4 | Ex. 5 |
| | Volume V2 ($mm^3$) | 5.1 | 5.1 | 5.1 | 5.1 | 5.1 |
| Cover | Composition | (a) | (b) | (c) | (d) | (d) |
| | MFR 210° C. × 2.16 kg | 27 | 15 | 16 | NG1 | NG1 |
| | MFR 240° C. × 2.16 kg | NG2 | NG2 | NG2 | 25 | 25 |
| | Hardness H3 (Shore D) | 70 | 69 | 69 | 69 | 69 |
| | Flexural modulus (MPa) | 600 | 550 | 480 | 600 | 600 |
| | Thickness (mm) | 0.8 | 0.8 | 0.8 | 0.8 | 0.8 |
| | Weight W3 (g) | 4.52 | 4.52 | 4.52 | 4.61 | 4.61 |
| | Volume V3 ($mm^3$) | 4.43 | 4.43 | 4.43 | 4.43 | 4.43 |
| Ball | H3 − H2 | 20 | 19 | 19 | 19 | 19 |
| | W2 + W3 (g) | 10.79 | 10.79 | 10.79 | 10.88 | 10.42 |
| | V2 + V3 ($mm^3$) | 9.53 | 9.53 | 9.53 | 9.53 | 9.53 |
| Flight distance (m) | | 235 | 234 | 234 | 231 | 229 |
| Durability (Index) | | 100 | 100 | 100 | 100 | 105 |
| Moldability | | A | A | A | A | A |

NG1: Measurement was impossible due to difficulty in flowing.

NG2: Measurement was impossible due to excessive flow.

TABLE 6

| Results of Evaluation | | | | | | |
|---|---|---|---|---|---|---|
| | | Ex. 6 | Com. Ex. 1 | Com. Ex. 2 | Ex. 7 | Ex. 8 |
| Core | Type | (4) | (5) | (6) (7) | (2) | (1) |
| | H(5.0) − Ho | 11.0 | 4.5 | 5.0 | 11.0 | 11.0 |
| | H(12.5) − H(5.0) | 1.0 | 2.5 | 10.0 | 1.0 | 1.0 |
| | Hs − H(12.5) | 15.0 | 9.0 | 16.0 | 15.0 | 15.0 |
| | Hs − Ho | 27.0 | 16.0 | 31.0 | 27.0 | 27.0 |
| Mid layer | Composition | (i) | (ii) | (i) | (ii) | (i) |
| | Hardness H2 (Shore D) | 50 | 50 | 50 | 50 | 50 |
| | Thickness (mm) | 0.8 | 1.0 | 0.8 | 1.0 | 1.0 |
| | Weight W2 (g) | 4.67 | 6.27 | 4.67 | 6.27 | 5.81 |
| | Volume V2 ($mm^3$) | 4.1 | 4.1 | 4.1 | 5.1 | 5.1 |
| cover | Composition | (d) | (d) | (d) | (e) | (e) |
| | MFR 210° C. × 2.16 kg | NG1 | NG1 | NG1 | NG1 | NG1 |
| | MFR 240° C. × 2.16 kg | 25 | 25 | 25 | 20 | 20 |
| | Hardness H3 (Shore D) | 69 | 69 | 69 | 68 | 68 |
| | Flexural modulus (MPa) | 600 | 600 | 600 | 550 | 550 |
| | Thickness (mm) | 0.8 | 0.8 | 0.8 | 0.8 | 0.8 |
| | Weight W3 (g) | 4.61 | 4.61 | 4.61 | 4.56 | 4.56 |
| | Volume V3 ($mm^3$) | 4.43 | 4.43 | 4.43 | 4.43 | 4.43 |
| Ball | H3 − H2 | 19 | 19 | 19 | 18 | 18 |
| | W2 + W3 (g) | 9.28 | 10.7 | 9.28 | 10.84 | 10.38 |
| | V2 + V3 ($mm^3$) | 8.53 | 8.53 | 8.53 | 9.53 | 9.53 |
| Flight distance (m) | | 230 | 227 | 234 | 231 | 229 |
| Durability (Index) | | 105 | 100 | 55 | 100 | 103 |
| Moldability | | A | A | A | A | A |

NG1: Measurement was impossible due to difficulty in flowing.

TABLE 7

Results of Evaluation

| | | Ex. 9 | Com. Ex. 3 | Ex. 10 | Ex. 11 |
|---|---|---|---|---|---|
| Core | Type | (4) | (5) | (3) | (3) |
| | H(5.0)-Ho | 11.0 | 4.5 | 11.0 | 11.0 |
| | H(12.5)-H(5.0) | 1.0 | 2.5 | 1.0 | 1.0 |
| | Hs-H(12.5) | 15.0 | 9.0 | 15.0 | 15.0 |
| | Hs-Ho | 27.0 | 16.0 | 27.0 | 27.0 |
| Mid layer | Composition | (i) | (ii) | (ii) | (ii) |
| | Hardness H2 (Shore D) | 50 | 50 | 50 | 50 |
| | Thickness (mm) | 0.8 | 1.0 | 1.0 | 1.0 |
| | Weight W2 (g) | 4.67 | 6.27 | 6.27 | 6.27 |
| | Volume V2 ($mm^3$) | 4.1 | 5.1 | 5.1 | 5.1 |
| Cover | Composition | (e) | (e) | (f) | (g) |
| | MFR 210° C. × 2.16 kg | NG1 | NG1 | 5 | 12 |
| | MFR 240° C. × 2.16 kg | 20 | 20 | NG2 | NG2 |
| | Hardness H3 (Shore D) | 68 | 68 | 66 | 68 |
| | Flexural modulus (MPa) | 550 | 550 | 390 | 420 |
| | Thickness (mm) | 0.8 | 0.8 | 0.8 | 0.8 |
| | Weight W3 (g) | 4.56 | 4.56 | 4.39 | 4.44 |
| | Volume V3 ($mm^3$) | 4.43 | 4.43 | 4.43 | 4.43 |
| Ball | H3 − H2 | 18 | 18 | 16 | 18 |
| | W2 + W3 (g) | 9.24 | 10.83 | 10.67 | 10.72 |
| | V2 + V3 ($mm^3$) | 8.53 | 9.53 | 9.53 | 9.53 |
| Flight distance (m) | | 230 | 226 | 228 | 230 |
| Durability (Index) | | 98 | 105 | 105 | 100 |
| Moldability | | A | A | A | A |

NG1: Measurement was impossible due to difficulty in flowing.
NG2: Measurement was impossible due to excessive flow.

TABLE 8

Results of Evaluation

| | | Ex. 12 | Ex. 13 | Com. Ex. 4 | Com. Ex. 5 |
|---|---|---|---|---|---|
| Core | Type | (2) | (2) | (3) | (3) |
| | H(5.0)-Ho | 11.0 | 11.0 | 11.0 | 11.0 |
| | H(12.5)-H(5.0) | 1.0 | 1.0 | 1.0 | 1.0 |
| | Hs-H(12.5) | 15.0 | 15.0 | 15.0 | 15.0 |
| | Hs-Ho | 27.0 | 27.0 | 27.0 | 27.0 |
| Mid layer | Composition | (ii) | (ii) | (ii) | (ii) |
| | Hardness H2 (Shore D) | 50 | 50 | 50 | 50 |
| | Thickness (mm) | 1.0 | 1.0 | 1.0 | 1.0 |
| | Weight W2 (g) | 6.27 | 6.27 | 6.27 | 6.27 |
| | Volume V2 ($mm^3$) | 5.1 | 5.1 | 5.1 | 5.1 |
| Cover | Composition | (h) | (i) | (j) | (k) |
| | MFR 210° C. × 2.16 kg | NG1 | 8 | NG2 | NG1 |
| | MFR 240° C. × 2.16 kg | 35 | NG2 | NG2 | NG1 |
| | Hardness H3 (Shore D) | 70 | 70 | 64 | 54 |
| | Flexural modulus (MPa) | 580 | 520 | 310 | 185 |

TABLE 8-continued

Results of Evaluation

| | | Ex. 12 | Ex. 13 | Com. Ex. 4 | Com. Ex. 5 |
|---|---|---|---|---|---|
| | Thickness (mm) | 0.8 | 0.8 | 0.8 | Molding was impossible |
| | Weight W3 (g) | 4.57 | 4.55 | 4.34 | |
| | Volume V3 ($mm^3$) | 4.43 | 4.43 | 4.43 | |
| Ball | H3 − H2 | 20 | 20 | 14 | — |
| | W2 + W3 (g) | 10.85 | 10.82 | 10.61 | — |
| | V2 + V3 ($mm^3$) | 9.53 | 9.53 | 9.53 | — |
| Flight distance (m) | | 232 | 229 | 227 | — |
| Durability (Index) | | 100 | 100 | 120 | — |
| Moldability | | A | A | A | B |

NG1: Measurement was impossible due to difficulty in flowing.
NG2: Measurement was impossible due to excessive flow.

As shown in Tables 5 to 8, the golf balls according to Examples are excellent in various performance characteristics. From the results of evaluation, advantages of the present invention are clear.

The golf ball according to the present invention can be used for playing golf on golf courses and practicing at driving ranges. The above descriptions are merely for illustrative examples, and various modifications can be made without departing from the principles of the present invention.

What is claimed is:

1. A golf ball comprising a core, a mid layer positioned outside the core, and a cover positioned outside the mid layer, wherein a difference between: a JIS-C hardness H(5.0) at a point that is located at a distance of 5 mm from a central point of the core; and a JIS-C hardness Ho at the central point is equal to or greater than 6.0, a difference between: a JIS-C hardness H(12.5) at a point that is located at a distance of 12.5 mm from the central point; and the hardness H(5.0) is equal to or less than 4.0, a difference between a JIS-C hardness Hs at a surface of the core and the hardness H(12.5) is equal to or greater than 10.0, a difference between the hardness Hs and the hardness Ho is equal to or greater than 22.0, there is no zone in which a hardness decreases from the central point toward the surface, a Shore D hardness H3 of the cover is greater than a Shore D hardness H2 of the mid layer, and the cover is formed from a resin composition, and a base resin of the resin composition contains, as a component (A), a polyamide copolymer that contains:

(a-1) a polymerized fatty acid, (a-2) sebacic acid and/or azelaic acid, and (a-3) a polyamine component, and as a component (B), at least one member selected from the group consisting of:

(b-1) a binary copolymer formed with an olefin and an α,β-unsaturated carboxylic acid having 3 to 8 carbon atoms, (b-2) a metal ion neutralized product of a binary copolymer formed with an olefin and an α,β-unsaturated carboxylic acid having 3 to 8 carbon atoms, (b-3) a ternary copolymer formed with: an olefin; an α,β-unsaturated carboxylic acid having 3 to 8 carbon atoms; and an α,β-unsaturated carboxylate ester, and (b-4) a metal ion neutralized product of a ternary copolymer formed with: an olefin; an α,β-unsaturated carboxylic acid having 3 to 8 carbon atoms; and an α,β-unsaturated carboxylate ester.

2. The golf ball according to claim 1, wherein the resin composition of the cover further contains a polyamide resin composition (C) that:

(c-1) a polyamide resin, and (c-2) a resin having at least one functional group selected from the group consisting of a hydroxyl group, a carboxyl group, an anhydride group, a sulfonic group, and an epoxy group (including a glycidyl group).

3. The golf ball according to claim 2, wherein, in the resin composition of the cover, a proportion of a sum of the component (A), the component (B), and the component (C) to a total base resin is 100% by weight, a proportion of the component (A) to the total base resin is equal to or greater than 1% by weight but equal to or less than 70% by weight, a proportion of the component (B) to the total base resin is equal to or greater than 15% by weight but equal to or less than 65% by weight, and a proportion of the component (C) to the total base resin is equal to or greater than 15% by weight but equal to or less than 60% by weight.

4. The golf ball according to claim 1, wherein the resin composition of the cover contains at least either one of the binary copolymer (b-1) or the metal ion neutralized product of the binary copolymer (b-2), and at least either one of the ternary copolymer (b-3) or the metal ion neutralized product of the ternary copolymer (b-4).

5. The golf ball according to claim 1, wherein the resin composition of the cover contains the metal ion neutralized product of the binary copolymer (b-2) and the metal ion neutralized product of the ternary copolymer (b-4).

6. The golf ball according to claim 1, wherein the resin composition of the cover contains, as the metal ion neutralized product of the binary copolymer (b-2), a binary ionomer resin neutralized with sodium and a binary ionomer resin neutralized with zinc.

7. The golf ball according to claim 1, wherein, in the resin composition of the cover, a proportion of a sum of the component (A) and the component (B) to a total base resin is 100% by weight, a proportion of the component (A) to the total base resin is equal to or greater than 10% by weight but equal to or less than 80% by weight, and a proportion of the component (B) to the total base resin is equal to or greater than 20% by weight but equal to or less than 90% by weight.

8. The golf ball according to claim 1, wherein a melt flow rate (240° C.×2.16 kg) of the resin composition of the cover is equal to or greater than 10 g/10 min.

9. The golf ball according to claim 1, wherein a flexural modulus of the resin composition of the cover is equal to or greater than 350 MPa but equal to or less than 1000 MPa.

10. The golf ball according to claim 1, wherein the Shore D hardness H3 of the cover is equal to or greater than 66 but equal to or less than 75.

11. The golf ball according to claim 1, wherein the core is formed by crosslinking a rubber composition that includes a base rubber and an organic sulfur compound, and the organic sulfur compound has a molecular weight of 150 or higher but 200 or lower and a melting point of 65° C. or higher but 90° C. or lower.

12. The golf ball according to claim 11, wherein the rubber composition includes the base rubber in an amount of 100 parts by weight, and the organic sulfur compound in an amount that is equal to or greater than 0.05 parts by weight but equal to or less than 3.0 parts by weight.

13. The golf ball according to claim 11, wherein the sulfur compound is 2-naphthalenethiol.

14. The golf ball according to claim 1, wherein the hardness Ho is equal to or greater than 40.0 but equal to or less than 70.0, and the hardness Hs is equal to or greater than 78.0 but equal to or less than 95.0.

15. The golf ball according to claim 1, wherein a thickness of the mid layer is equal to or greater than 0.5 mm but equal to or less than 1.2 mm.

16. The golf ball according to claim 1, wherein a thickness of the cover is equal to or greater than 0.3 mm but equal to or less than 1.5 mm.

17. The golf ball according to claim 1, wherein a sum (W2+W3) of a weight W2 of the mid layer and a weight W3 of the cover is equal to or greater than 8.4 g but equal to or less than 12.0 g, and a sum (V2+V3) of a volume V2 of the mid layer and a volume V3 of the cover is equal to or less than 10 $cm^3$.

18. The golf ball according to claim 1, wherein a difference between a specific gravity of the mid layer and a specific gravity of the core is equal to or greater than 0.05 but equal to or less than 0.4.

19. The golf ball according to claim 1, wherein a difference between a hardness of the cover and a hardness of the mid layer is equal to or greater than 4 but equal to or less than 20.

* * * * *